US005123430A

United States Patent [19]

Davidovitz

[11] Patent Number: 5,123,430

[45] Date of Patent: Jun. 23, 1992

[54] CUTTER DEVICE FOR FINGERNAILS OR TOENAILS

[76] Inventor: Zvi Davidovitz, 37 Abardanel Street, Rishon Lezion, Israel

[21] Appl. No.: 741,009

[22] Filed: Aug. 6, 1991

Related U.S. Application Data

[63] Continuation-in-part of Ser. No. 614,468, Nov. 16, 1990, abandoned.

[30] Foreign Application Priority Data

Jan. 23, 1990 [IL] Israel ..... 93142

[51] Int. Cl.[5] ..... A45D 29/05

[52] U.S. Cl. ..... 132/75.8; 132/73.6; 132/75.4; 132/75.5; 30/26; 30/29; 30/276

[58] Field of Search ..... 132/73.5, 73.6, 75, 132/75.3, 75.4, 75.5, 75.8; 30/26, 29, 347, 276

[56] References Cited

U.S. PATENT DOCUMENTS

| | | | |
|---|---|---|---|
| 2,532,370 | 12/1950 | Perrill | 30/29 |
| 2,544,248 | 3/1951 | Ashmead | 132/73.6 |
| 4,753,253 | 6/1988 | Hutson | 132/73.6 |
| 4,854,334 | 8/1989 | Su | 132/73.6 |

FOREIGN PATENT DOCUMENTS

| | | | |
|---|---|---|---|
| 1457446 | 1/1969 | Fed. Rep. of Germany | 30/26 |
| 1457442 | 3/1969 | Fed. Rep. of Germany | 132/73.6 |
| 2752179 | 6/1979 | Fed. Rep. of Germany | 132/73.6 |
| 8005818 | 5/1982 | Netherlands | 132/73.6 |
| 2191396 | 12/1987 | United Kingdom | 132/73.6 |

*Primary Examiner*—John J. Wilson
*Assistant Examiner*—Frank A. LaViola
*Attorney, Agent, or Firm*—Benjamin J. Barish

[57] ABSTRACT

A cutter device particularly useful for cutting fingernails and toenails includes a housing grippable by a user for holding and manipulating the device. A slot is formed in a conical end portion of the housing and is elongated in the circumferential direction for receiving a nail to be cut. A rotatable head having an outer conical surface is rotatably mounted within the conical end portion of the housing. A blade is fixed to the rotatable head and has a cutting edge extending substantially radially of the conical surface of the head and perpendicularly to the slot. A motor within the housing and coupled to the head rotates the head, and the blade fixed thereto, such that the cutting edge of the blade is rotated substantially perpendicularly to the direction of elongation of the slot and the nail received therein.

16 Claims, 4 Drawing Sheets

FIG 8
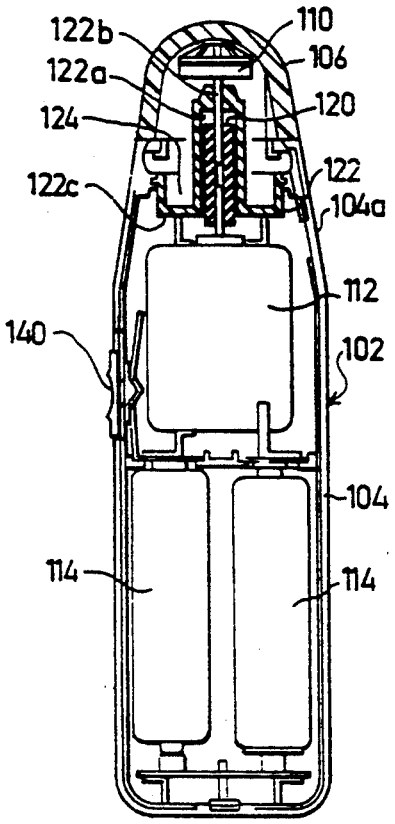
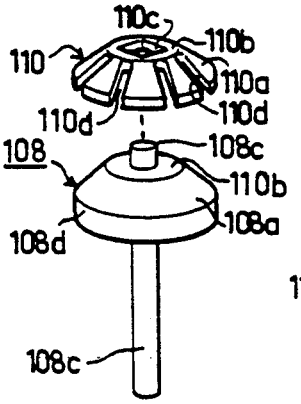
FIG 10
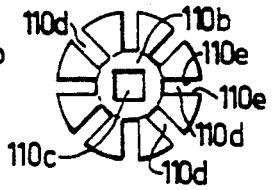
FIG 11
FIG 9
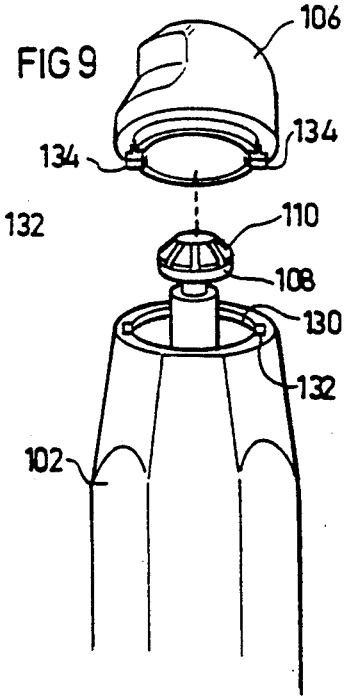
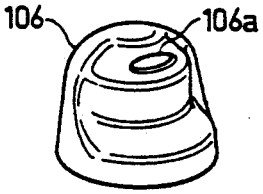
FIG 12

CUTTER DEVICE FOR FINGERNAILS OR TOENAILS

RELATED APPLICATION

The present application is a continuation-in-part application of prior application Ser. No. 07/614,468, filed Nov. 16, 1990, which application is still pending.

FIELD AND BACKGROUND OF THE INVENTION

The present invention relates to a cutter device, and particularly to a cutter device useful for cutting fingernails or toenails.

At the present time, fingernails and toenails are usually cut by scissors, clippers, or a simple knife. However, such manually-operated implements are awkward or time-consuming to use, do not cut uniformly, may be difficult and/or even useless with respect to very thick nails, and/or may accidentally cut surrounding skin.

A number of motor-operated filing devices have been proposed, as illustrated for example in U.S. Pat. Nos. 4,896,684, 4,753,253, 4,213,471, 3,255,766 and 2,056,379, and British Patent Application 2,191,396, but such devices trim or file the nail by abrasion, rather than by cutting, and therefore are relatively time-consuming to use particularly when substantial portions of the nail are to be cut away. U.S. Pat. No. 2,532,370 and Netherlands Patent 8005818 disclose motor-operated fingernail cutters, but such devices have not attained commercial use insofar as I am aware.

OBJECTS AND BRIEF SUMMARY OF THE INVENTION

An object of the present invention is to provide a novel motor-operated cutter device particularly useful for cutting fingernails or toenails in a quick, efficient, safe and convenient manner.

According to the present invention, there is provided a cutter device particularly useful for cutting fingernails and toenails, comprising: a housing grippable by a user for holding and manipulating the device, and having a conical end portion; a slot formed in the conical end portion of the housing an elongated in the circumferential direction thereof for receiving a nail to be cut; a rotatable head having an outer conical surface rotatably mounted within, the conical end portion of the housing; a blade fixed to the rotatable head and having a cutting edge extending substantially radially of the conical surface of the head and perpendicularly to the slot; and a motor within the housing and coupled to the head to rotate the head, and the blade fixed thereto, such that the cutting edge of the blade is rotated substantially perpendicularly to the direction of elongation of the slot and the nail received therein.

Two embodiments of the invention are described below for purposes of example.

According to one described embodiment, the outer conical surface of the head is formed with a radially-extending recess bordered on one side by a seat, and the blade includes a single cutting edge. The blade is fixed to the head so as to overlie the one side of the recess, with the cutting edge of the blade spaced from, and substantially parallel to, the other side of the recess.

According to a second described embodiment, the blade is also of conical configuration conforming to the outer conical surface of the head; and the blade is formed with a plurality of radial slots extending completely through the blade, starting from its outer periphery to an unslotted region centrally thereof, defining a plurality of cutting edges extending substantially radially of the conical surface of the blade and perpendicularly to the slots.

It has been found that a cutter device constructed in accordance with the foregoing features can be used for cutting fingernails and toenails in a quick, efficient, uniform and safe manner.

Further features and advantages of the invention will be apparent from the description below.

BRIEF DESCRIPTION OF THE DRAWINGS

The invention is herein described, by way of example only, with reference to the accompanying drawings, wherein:

FIG. 8 is a side view, with parts shown in section, illustrating a second form of cutter device constructed in accordance with the present invention;

FIG. 9 is an exploded view of the end of the cutter device of FIG. 8 mounting the cutting blade;

FIG. 10 is an exploded view illustrating the cutting blade of FIG. 8 and the rotatable head to which it is mounted;

FIG. 11 is a plan view of the cutting blade of FIG. 8; and

FIG. 12 is a perspective view of the housing cover at the cutting end of the device of FIG. 8.

DESCRIPTION OF PREFERRED EMBODIMENTS

The Embodiment of FIGS. 1–7

Figure 1:
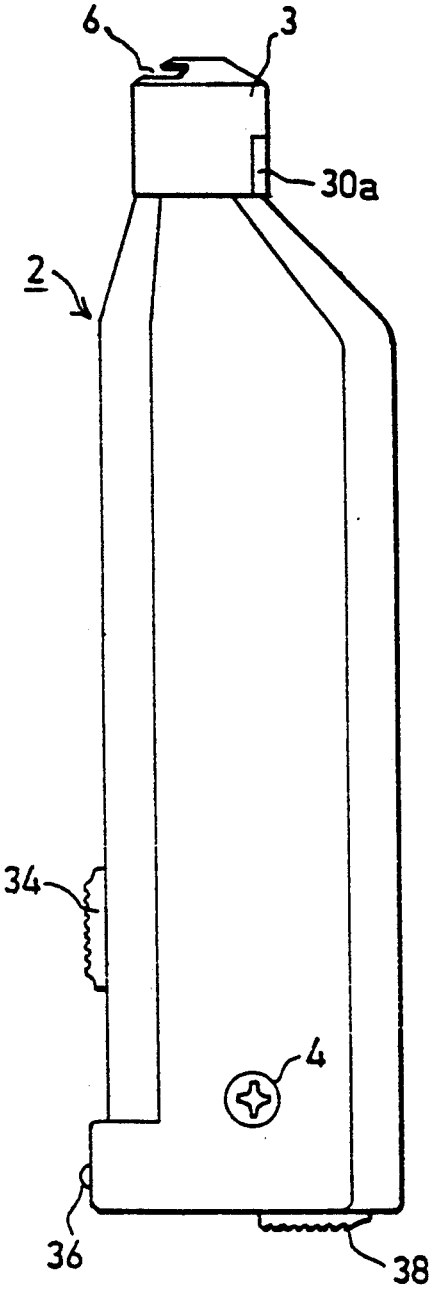
FIGS. 1, 2 and 3 are side, front and top views, respectively, of one form of cutter device constructed in accordance with the present invention.
Figure 2:
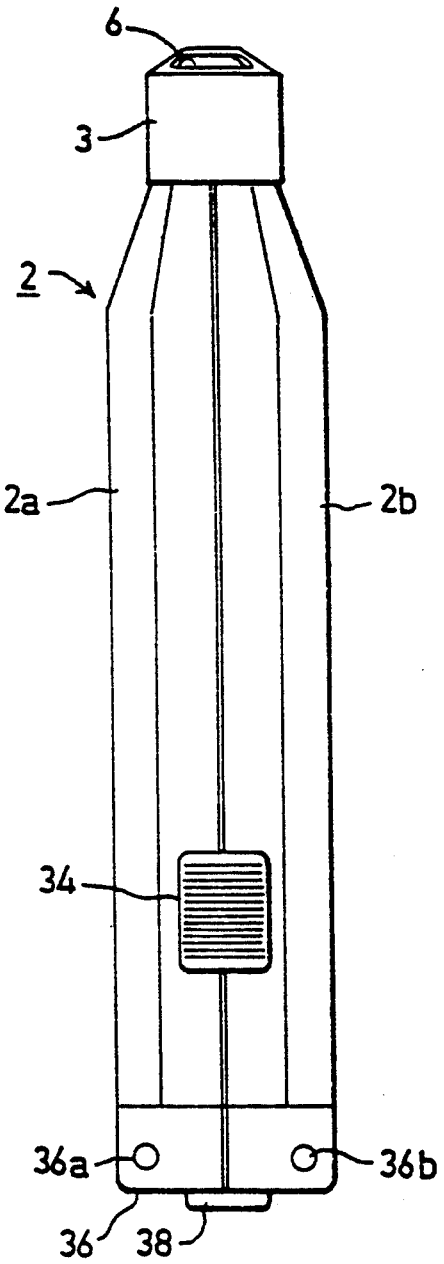
Figure 3:
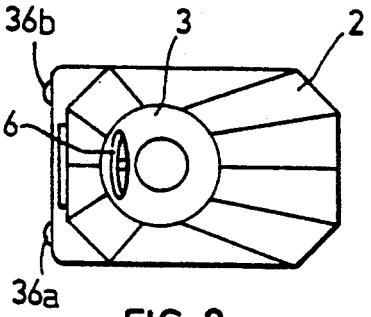

The cutter device illustrated in FIGS. 1–7 of the drawings comprises a housing, generally designated 2, constituted of two half-sections 2*a*, 2*b* and a removable end section or cover 3. The half-sections 2*a*, 2*b* are secured together by a threaded fastener 4 (FIG. 1), and the cover 3 is removably received over one end of the housing. The removable cover 3 is formed with a slot 6 at one end for receiving the nail to be cut by a cutting blade within the housing. The remainder of the housing is shaped so as to be conveniently grippable by the user for manipulating the device.

The removable cover 3 encloses a rotatably-mounted cutter head 8 carrying a blade 10 having a cutting edge 10*a* adapted to move under slot 6 so as to cut the nail inserted into the slot. The cutter head 8 is coupled by a shaft 11 to an electric motor 12 disposed within the housing 2 and supplied by electrical batteries 14 also disposed within the housing. Shaft 11 is supported by a bearing 16 carried by a partition 18 integrally formed in the two housing sections 2*a*, 2*b*, and is coupled to motor 12 by a coupling member 20, e.g., a gear.

The cutter head 8 is of a solid, preferably metal, construction. It is formed with a bore for receiving the motor drive shaft 11, and to which it is secured by an end fastener nut 21.

Cutter head 8 includes a frusto-conical section 8*a* and a cylindrical skirt section 8*b*, and is formed with a recess or cavity 22 extending substantially radially through both sections 8*a*, 8*b*. The cutter head is further formed with a seat 24 on which the blade 10 is secured by a threaded fastener 26.

Figure 5:
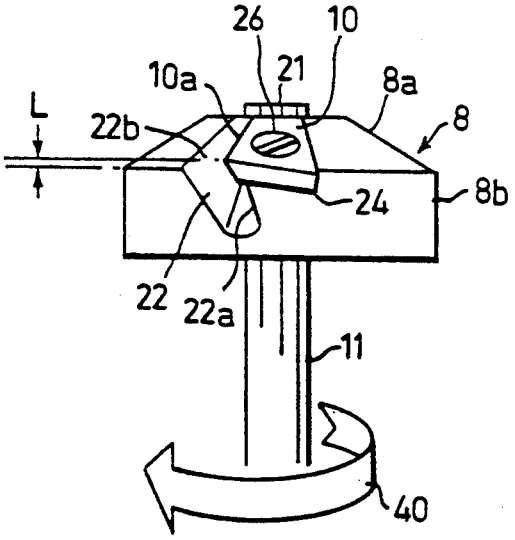
FIG. 5 is an enlarged fragmentary view illustrating the rotatable cutting head in the device of FIGS. 1–3.

As shown particularly in FIG. 5, blade 11 is slightly longer, in the direction of rotation of the cutter head 8, than seat 24, so that the cutting edge 10*a* of the blade extends past edge 22*a* of the recess 22, but terminates slightly short of and parallel to its other edge 22*b*. As further shown in FIG. 5, seat 24 is formed obliquely to the rotary axis of the cutter head 8, defined by the longitudinal axis of shaft 10, such that the cutting edge 10*a* of blade 10 projects slightly outwardly, by the distance indicated as "L" in FIG. 5, from the outer surface of the frusto-conical section 8*a* of the cutter head. This distance "L" fixes the thickness of the cuttings.

The removable cover 3 enclosing the cutter head 8 includes a similar frusto-conical section 3*a* and cylindrical skirt 3*b*. Slot 6 for receiving the nail to be cut is formed in the frusto-conical section 3*a* in the circumferential direction. The cylindrical skirt 3*b* is removably received on a cylindrical end section 30 of the two housing halves 2*a*, 2*b*. In order to angularly locate the removable housing section 3, and particularly its slot 6, with respect to the cutter head 8, the housing end section 30 is formed with an axially-extending rib 30*a* adapted to be received within a recess (shown as a slot) 3*c* formed axially in the cylindrical skirt 3*b*.

Figure 4:
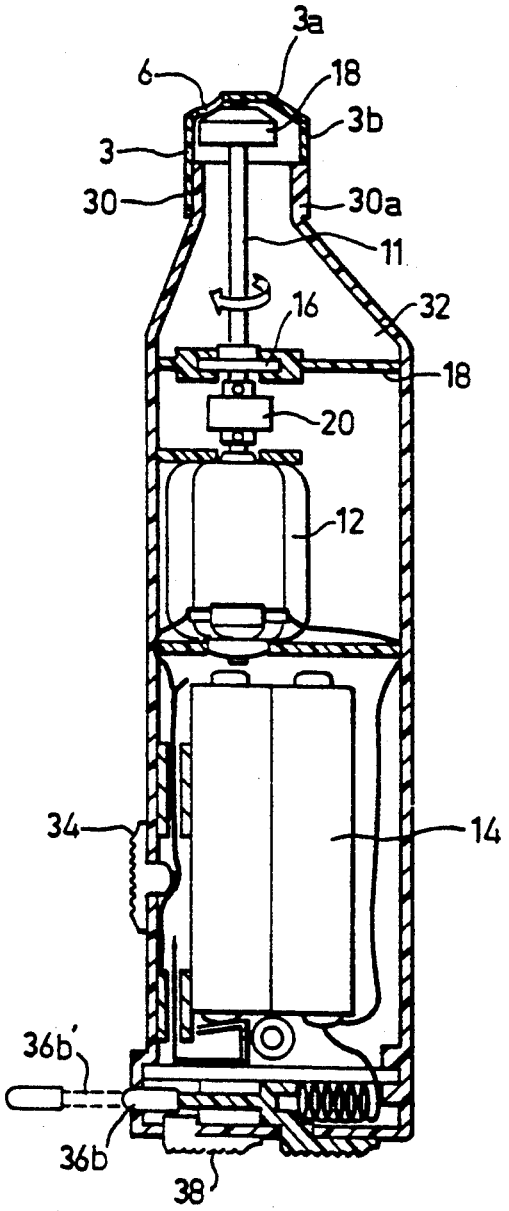
FIG. 4 is a side view of the device of FIGS. 1–3 with a part of the housing removed to show its internal structure.
Figure 6:
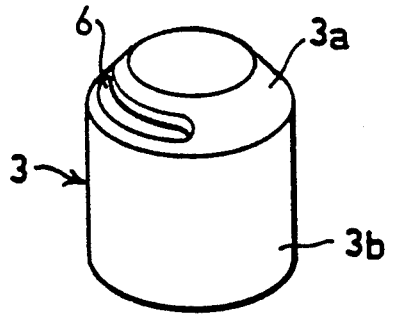
FIG. 6 is a three-dimensional view of the removable housing section covering the rotatable cutting head.
Figure 7:
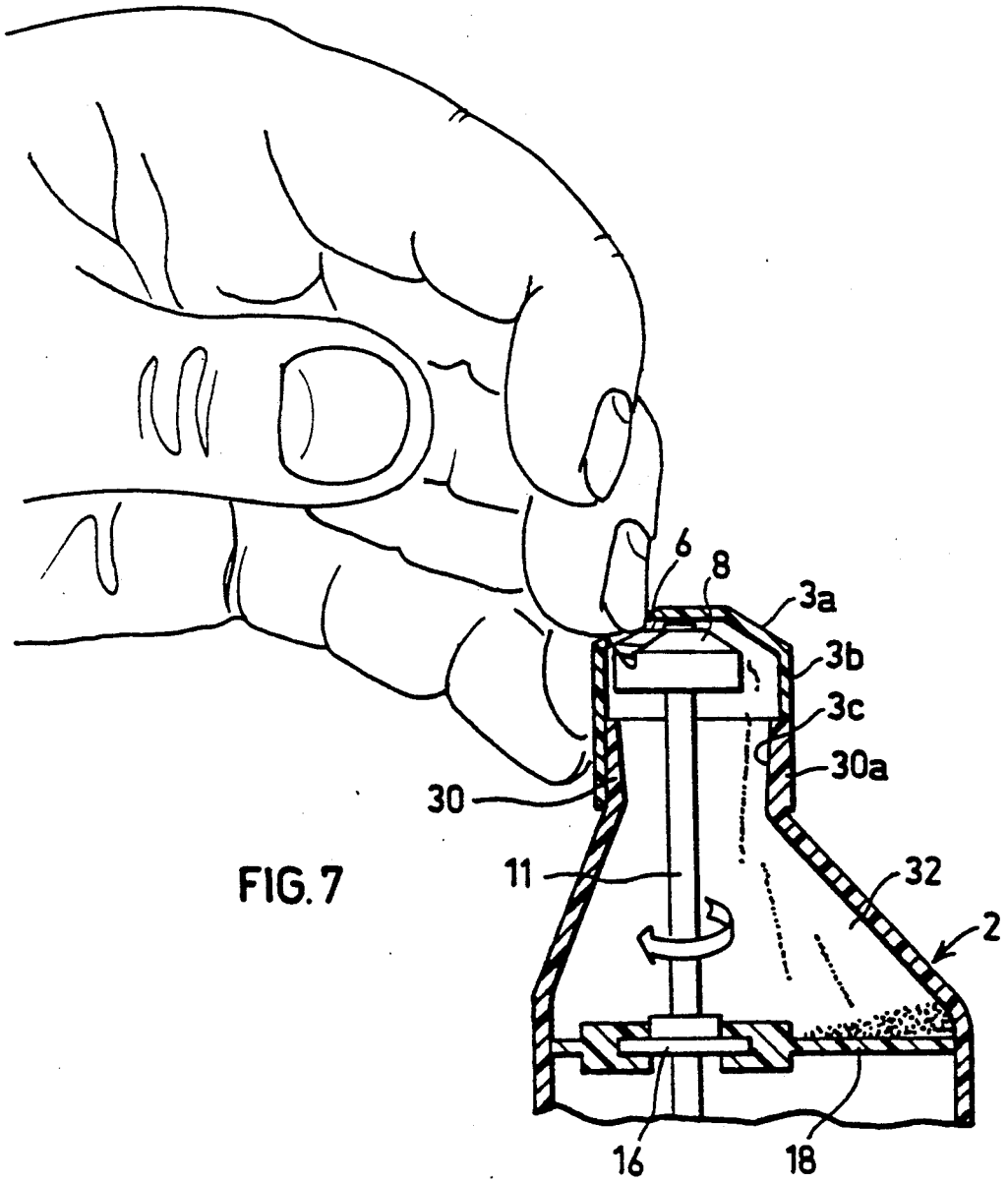
FIG. 7 illustrates the manner of using the device of FIGS. 1–3.

As shown in FIGS. 4 and 7, cutter head 8 is rotatably mounted eccentrically with respect to the removable cover 3, i.e., closer to the side of cover 3 formed with the slot 6. Thus, there is more space between the cutter head and the opposite side of the removable housing section 3. This space enables the nail cuttings, after being cut during the rotation of the cutter head, to be directed by centrifugal action to, and to accumulate within, a compartment 32 defined by the partition 18. This compartment may be emptied of the cuttings by merely removing cover 3 and pouring out the accumulated cuttings through the thus- opened end of the housing.

The illustrated cutter device further includes a manually-operated electrical switch 34, and an electrical plug 36 including a pair of prongs 36*a*, 36*b*, extensible by a slide 38 to the broken-line portion shown by prong 36*b*' in FIG. 4, in order to insert the plug into a socket for recharging the batteries 14, when rechargeable batteries are used.

The cutter device illustrated in FIGS. 1–7 is used in the following manner:

Whenever a fingernail or toenail is to be cut, electric motor 12 is energized by operation of switch 34 to rotate the cutter head 8. The nail to be cut is inserted into slot 6 as shown particularly in FIG. 7.

It will be seen that the cutting edge 10*a* extends substantially perpendicularly to the direction of elongation of slot 6, and thereby to the nail to be cut, and that cutting head 8 is rotated to drive the cutting edge 10*a* (in the direction shown by arrow 40 in FIG. 5) substantially parallel to the direction of the slot. Thus, the nail inserted into the slot 6 is cut neatly, quickly and safely by the cutting edge 10*a* of the blade 10, without any significant component of force applied outwardly with respect to the nail tending to break it.

The cuttings are automatically directed by centrifugal action, produced by the rotation of the head, away from the slot 6 and into the space between the cutting head and the cover 3 opposite to the slot, and fall by gravity to the bottom of compartment 32. Whenever desired, compartment 32 may be emptied of the cuttings by merely removing the cover 3 and inverting the housing to pour out the cuttings from the thus-opened end of the housing.

It will thus be seen that the illustrated cutter device is convenient, quick and safe to use since only the fingernail projecting through slot 6 is engageable by the cutting edge of the cutter head, and accumulates all the cuttings within it for easy removal whenever desired.

The Embodiment of FIGS. 8–12

The cutter device illustrated in FIGS. 8–12 of the drawings comprises a housing, generally designated 102, including a main section 104, and a removable cover 106 at one end. The removable cover 106 is of generally conical configuration. The main section 104*a* is of generally cylindrical configuration to facilitate manually gripping and manipulating the device, but its end portion 104*b*, receiving the removable cover 106, is of frusto-conical configuration to provide a smooth juncture with the cover.

As shown particularly in FIG. 12, the removable cutter 106 is formed with a slot 106*a* elongated in the circumferential direction for receiving a nail to be cut by a cutting blade within the housing. Thus, as shown particularly in FIGS. 9 and 10, the cover 106 encloses a cutter head 108 to which the cutter blade 110 is fixed. The cutter head 108 is coupled to an electric motor 112 disposed within the housing 102 and supplied by electrical batteries 114 also disposed within the housing.

The cutter head 108 is of a solid, preferably metal, construction. It includes an outer conical (or frusto-conical) surface 108*a* substantially conforming to the inner conical surface of cover 106. A flat surface 108*b* is formed centrally of conical surface 108*a* and includes a central cylindrical projection 108*c* for use in securing the cutter blade 110 to the head 108. The cutter head 108 is further formed with a cylindrical skirt section 108*d* and a stem 108*e* depending from the latter section, i.e., on the side of the cutter head opposite to that receiving the cutter blade 110.

The cutter blade 110 is formed with a conical (or frusto-conical) section 110*a* conforming to the conical surface 108*a* of the cutter head 108. Blade 110 is further formed with a flattened surface 110*b* engageable with flat surface 108*b* of the cutter head, and with a central opening 110*c* for receiving projection 108*c* of the cutter head. Opening 110*c* of the blade is of non-circular (e.g., square) configuration. Thus, blade 110 is fixedly secured to the head 108 by passing projection 108*c* through opening 110*c* and then splaying the projection, e.g., by an impact implement, to spread or turn out the projection and to fill the opening 110*c*.

Conical section 110*a* of the cutter blade 11 is punched out with a plurality of radially-extending slots 110*d* around the circumference of the blade. The radial slots 110*d* extend completely through the thickness of the blade, starting from its outer periphery to the flattened central region 110*b*, which is not slotted. The radial slots thus form a plurality of spaced radially-extending cutting edges 110*e* extending from the unslotted central region to the outer periphery of the blade. It will thus be seen that the cutting edges 110*e* of the cutting blade 110 also extend substantially radially of the conical surface 108*a* of head 108 and perpendicularly to the slot 106*a* formed in the cover 106 receiving the fingernail to be cut.

The cutter head 108 is coupled to the electric motor 112 by a flexible tubular coupling 120 (FIG. 8) receiving the cutter head stem 108*e* at one end, and the shaft 112*a* of the electric motor 112 at the opposite end. The flexible tubular coupling 120, e.g., of rubber, passes through a plastic bushing 122 mounted within the housing 102 between motor 112 an the cutter head 108. Bushing 122*a* is formed with a passageway 122*a* for receiving the flexible tubular coupling 120. Passageway 122*a* terminates at one end in an opening 122*b* of smaller diameter than the passageway for receiving the stem 108*e* of the cutter head. The opposite end of bushing 120 is formed with a disc section 122*c* closing the respective end of the housing so as to define a compartment 124 with the housing for receiving the nail cuttings.

The end of housing 102 closed by cover 106 is formed with a circumferentially-extending rib 130 and with a pair of axially-extending slots 132 on diametrically-opposite sides of the rib 130, to define, with the rib, a bayonet-type slot for receiving a pair of bayonet-type projections 134 formed in the end of the cover 106. The cover 106 may be easily attached to the housing 102 by merely passing the projections 134 of cover 106 through slots 132 in the housing, and rotating the cover; and may be as easily removed by reversing this sequence of steps.

Housing 102 carries an electrical switch 140 which may be operated to energize motor 112 and thereby to rotate head 108, and the blade 110 carried thereby.

The cutter device illustrated in FIGS. 8–12 is used in the following manner:

Whenever a fingernail or toenail is to be cut, electric motor 12 is energized by operation of switch 140 to rotate the cutter head 108 and the cutter blade 110. The nail to be cut is inserted into slot 106*a*. As head 108 rotates, the cutting edges 110*e* of the cutting blade 110 move substantially perpendicularly to the direction of elongation of the slot 106*a* in the cover 106, and to the nail received in the slot. Accordingly, the cutting edges 110*e* will neatly cut the nail received in the slot. The cuttings will accumulate within compartment 124 defined by the housing 102 and the disc section 122*c* of the bushing 122.

Emptying the housing of the cutting accumulated within compartment 124 may be easily done by merely rotating cover 106 to align its projections 134 with slots 132, and then removing the cover from the housing.

In the arrangement illustrated in FIG. 12, the cover may be rotated 180° to selectively position the slot on one side of the housing for use by right-hand persons, or on the opposite side for use by left-hand persons.

While the invention has been described with respect to two preferred embodiments, it will be appreciated that many other variations, modifications and applications of the invention may be made.

What is claimed is:

1. A cutter device particularly useful for cutting fingernails and toenails, comprising:

a housing grippable by a user for holding and manipulating the device;

a slot formed in a wall of the housing for receiving a nail to be cut;

a rotatable head rotatably mounted within the housing;

a blade fixed to the rotatable head and rotatable therewith;

said blade being formed with a plurality of radial slots extending completely through the thickness of the blade, starting from its outer periphery to an unslotted region centrally thereof, to form a plurality of spaced cutting edges extending radially from said central unslotted region to the outer periphery of the blade;

said slot formed in a wall of the housing being elongated in the direction of rotation of the head and blade;

and a motor within the housing and coupled to the head to rotate the head, and the blade fixed thereto, such that the cutting edges of the blade are rotated substantially perpendicularly to the direction of elongation of the slot and the nail received therein.

2. The cutter device according to claim 1, wherein said housing wall formed with said slot is a removable cover of conical configuration, and said rotatable head and blade fixed thereto are also of conical configuration.

3. The cutter device according to claim 1, wherein said blade is formed with a central opening, and said head is formed with a central projection received within said opening and securing the blade to said head.

4. The cutter device according to claim 3, wherein said central opening is formed in a flat face in said central non-slotted region of the blade and is of non-circular configuration, and said central projection of the head is formed in a flat surface centrally of the head and is splayed to secure the blade to the head.

5. The cutter device according to claim 1, wherein said head is formed with a central stem on the side facing away from said blade, and said head is coupled to said motor by a flexible tubular coupling having one end receiving a shaft of the motor, and the opposite end receiving a shaft of the motor head.

6. The cutter device according to claim 5, further including a bushing mounted within said housing between the motor and head, said bushing having a central passageway for receiving said flexible tubular coupling and terminating in an opening of smaller diameter than the passageway for receiving said stem.

7. A cutter device particularly useful for cutting fingernails or toenails, comprising:

a housing grippable by a user for manipulating the device and having a conical portion;

a slot formed in the housing and elongated circumferentially thereof for receiving the nail to be cut;

a blade mounted within the housing and having a cutting edge located to extend substantially perpendicularly to the direction of elongation of said slot;

a rotatable head rotatable about a rotary axis and having an outer conical surface substantially conforming to the conical portion of the housing occupied by said slot;

said blade being fixed to the rotatable head with the cutting edge of the blade projecting slightly outwardly of the outer conical surface of the head;

said outer conical surface of the head being formed with a radially-extending recess bordered on one side with a seat for mounting the blade thereto to overlie said one side of said recess with the cutting edge of the blade being spaced from, and substantially parallel to, the other side of said recess;

and a motor within the housing for driving said blade across an undersurface of the housing just under the slot and substantially parallel to the direction of elongation of the slot, such that the cutting edge moves substantially perpendicularly to the slot and to a nail received within the slot.

8. The cutter device according to claim 7, wherein said seat extends obliquely to the rotary axis of the head to cause the cutting edge of the blade to project slightly outwardly of an outer surface of the cutting head.

9. The cutter device according to claim 7, wherein said blade is mounted to said seat of the head by a threaded fastener.

10. The cutter device according to claim 7, wherein said housing includes an internal partition defining a compartment for receiving nail cuttings produced during operation of the cutter device.

11. A cutter device particularly useful for cutting fingernails or toenails, comprising:

a housing grippable by a user for holding and manipulating the device, and having a conical end portion;

a slot formed in said conical end portion of the housing and elongated in the circumferential direction thereof for receiving a nail to be cut;

a rotatable head having an outer conical surface rotatably mounted within the conical end portion of the housing;

a blade fixed to said rotatable head;

said blade being also of conical configuration, conforming to the outer conical surface of the head;

said blade being formed with a plurality of radial slots extending completely through the thickness of the blade, starting from its outer periphery to an unslotted region centrally thereof, defining a plurality of cutting edges extending substantially radially of the conical surface of the blade and perpendicularly to said slot;

and a motor within the housing and coupled to said head to rotate the head, and the blade fixed thereto, such that the cutting edge of the blade is rotated substantially perpendicularly to the direction of elongation of the slot and the nail received therein.

12. The device according to claim 11, wherein said blade is formed with a central opening, and said conical head is formed with a central projection received within said opening and securing the blade to said head.

13. The device according to claim 12, wherein said central opening is formed in a flat face in said central non-slotted region of the blade and is of non-circular configuration, and said head projection is formed in a flat surface centrally of the head and is splayed to secure the blade to the head.

14. The device according to claim 11, wherein said head is formed with a central stem on the side facing away from said blade, and said head is coupled to said motor by a flexible tubular coupling having one end receiving a shaft of the motor, and the opposite end receiving said stem of the head.

15. The device according to claim 14, further including a bushing mounted within said housing between the motor and head, said bushing having a central passageway for receiving said flexible tubular coupling and terminating in an opening of smaller diameter than the passageway for receiving said stem.

16. The device according to claim 15, wherein said bushing further includes a disc defining, with said housing, a compartment for receiving nail cuttings, and said conical end portion of the housing is in the form of a cover removably attached to the remainder of the housing to facilitate emptying said compartment of nail cuttings accumulated therein.

* * * * *